US006059423A

United States Patent [19]

Knopick

[11] Patent Number: 6,059,423

[45] Date of Patent: May 9, 2000

[54] DECORATIVELY ILLUMINATED CARRYING DEVICE

[76] Inventor: Darlene J. Knopick, 151 Idle Rd., Marysville, Pa. 17053

[21] Appl. No.: 09/039,188

[22] Filed: Mar. 16, 1998

Related U.S. Application Data

[60] Provisional application No. 60/049,277, Jun. 10, 1997.

[51] Int. Cl.[7] ..... F21V 33/00

[52] U.S. Cl. ..... 362/156; 362/109; 362/249

[58] Field of Search ..... 362/109, 156, 362/249, 551, 252, 806

[56] References Cited

U.S. PATENT DOCUMENTS

| | | | |
|---|---|---|---|
| D. 258,205 | 2/1981 | Kroll | D9/305 |
| 2,334,084 | 11/1943 | Gold et al. | 362/156 |
| 4,698,732 | 10/1987 | Hickey | 362/156 X |
| 4,802,071 | 1/1989 | Schuster | 362/154 |
| 4,839,777 | 6/1989 | Janko et al. | 362/108 |
| 4,926,296 | 5/1990 | Blume et al. | 362/156 |
| 5,019,438 | 5/1991 | Rapisarda | 428/102 |
| 5,073,844 | 12/1991 | Coyner et al. | 362/156 |
| 5,475,574 | 12/1995 | Chien | 362/108 |
| 5,567,054 | 10/1996 | Dalgleish | 362/156 X |
| 5,676,451 | 10/1997 | Tabanera | 362/156 |

FOREIGN PATENT DOCUMENTS

| | | |
|---|---|---|
| 121026 | 10/1984 | European Pat. Off. . |
| 246111 | 1/1926 | United Kingdom . |

*Primary Examiner*—Laura K. Tso
*Attorney, Agent, or Firm*—Richard C. Litman

[57] ABSTRACT

A decoratively illuminated carrying device for uses such as by a child to collect Halloween treats. The lights are positioned in a decorative pattern about a bag to produce light. The device provides increased safety and improves the child's ability to see and be seen.

3 Claims, 4 Drawing Sheets

DECORATIVELY ILLUMINATED CARRYING DEVICE

CROSS-REFERENCE TO RELATED APPLICATION

This application claims the benefit of U.S. Provisional Patent Application Ser. No. 60/049,277, filed Jun. 10, 1997.

BACKGROUND OF THE INVENTION

1. Field of the Invention

The present invention relates to lighted carrying devices, and more particularly to lighted carrying bags which are used to carry candy such as Halloween treats.

2. Description of Related Art

Decorative bags are used to hold or carry articles for many occasions. Examples include bags for carrying candy on Halloween and decorative bags for carrying gifts, such as on Christmas or Mother's Day. During Halloween, one common practice is to carry a flashlight in one hand (for illumination and safety) and a shopping bag in the other hand (for carrying treats). But, in the spirit of the occasion, numerous other more decorative devices for carrying Halloween treats have been invented. Moreover, since Halloween trick or treating generally takes place after dusk, two patented inventions provide lit devices for carrying Halloween treats. These inventions are described in U.S. Pat. No. 4,802,071 issued Jan. 31, 1989 to Schuster (Lantern Candy Carrier); and U.S. Pat. No. 4,926,296 issued May 15, 1990 to Blume et al. (Illuminated Carrying Bag).

The Schuster and Blume patents disclose placing battery-powered light bulbs inside Halloween bags and lanterns and thereby produce illuminated designs by shining the light through transparent portions of decorative bags or lanterns. Hence, the designs are produced by the bags, and not by the lights.

Other typical inventions generally related to the art include U.S. Pat. No. 4,839,777 issued Jun. 13, 1989 to Janko et al. (Illuminated Article); U.S. Pat. No. 5,019,438 issued May 28, 1991 to Rapisarda (Leather Article Decorated with Light Emitting Diodes); U.S. Pat. No. 5,073,844 issued Dec. 17, 1991 to Coyner et al. (Light Baggage Piece); U.S. Pat. No. 5,475,574 issued Dec. 12, 1995 to Chien (Shoulder Band with an EL Light Strip); U.S. Design Pat. No. 258,205 issued Feb. 10, 1981 to Kroll (Halloween Bag, or Similar Article); U.K. Pat. No. 246,411 issued Jan. 28, 1926 to McKee et al. (Illuminating Devices for Hand Bags); and European Pat. No. 0 121 026 published on Oct. 10, 1984 to Dana (Soft-soled Safety Shoe).

However, none of the inventions and patents, taken either singly or in combination, is seen to describe a lighted Halloween bag which produces decorative patterns solely by means of the positioning of the lights about the bag. Because such a device would provide increased safety and decoration over known devices, a need for the present invention exists.

SUMMARY OF THE INVENTION

The present invention is an illuminated carrying device in which lights are disposed upon the exterior surface of the device, thereby accomplishing two separate purposes. The first purpose is to provide illumination of the device and the surrounding environment. The second purpose is use the placement of the lights to create decorative designs. These two purposes can be achieved in various ways.

In one preferred embodiment, a plurality of lights, such as standard stringed, miniature Christmas lights, are attached to the exterior surface of a carrying bag. The lights are positioned around the exterior surface of the bag in an arrangement which creates a decorative design such as a ghost, witch, or goblin. The lights may either all be of the same kind, or alternatively, the lights may be of varying size, color or both.

Preferably, the bag is constructed out of two plies. In addition to providing additional structural support, this would enable the securement of the wiring and light sockets of the miniature light string between the two plies. Holes in the outer ply enable the lights to protrude from through outer ply to decoratively light the exterior. Also, the power supply for the lights may be positioned unobtrusively within the interior of the bag. Preferably, the power supply comprises at least one battery contained within a child-proof battery cartridge to prevent a curious child from opening the cartridge and losing the batteries. Optionally, an on/off switch may be included to conserve battery power when the lights are not in use.

In an alternate embodiment, a plurality of light sticks are used to provide illumination. The light sticks are first activated, and thereafter, placed within transparent pouches which are affixed upon the exterior surface of the bag. The bags may be provided with the transparent pouches pre-positioned in a decorative arrangement. Alternatively, the light sticks may be provided in combination with adhesively-backed pouches for retrofit attachment. The light-pouch combination is then placed on conventional carrying bags in decorative arrangements as chosen by the user.

In either embodiment, the exterior surface of the bag may be coated with a shiny or reflective material. The material would reflect the decorative lights, to even more greatly enhance the child's visibility. Alternatively, the exterior surface of the bag may be provided with pre-printed pictures. The surface may also be left blank intentionally, so as to allow the child to decorate the bag in a more personalized manner. Moreover, the surface of the bag may be provided with a pocket which is specially sized to hold special objects, such as greeting cards.

Accordingly, it is a principal object of the invention to provide a lighted device which uses the positioning of the lights to create decorative designs.

It is another object of the invention to provide a lighted device which is easily visible and allows a user to see and be seen by its light.

It is a further object of the invention to provide a lighted device so that the child does not have to carry both a bag and a light.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
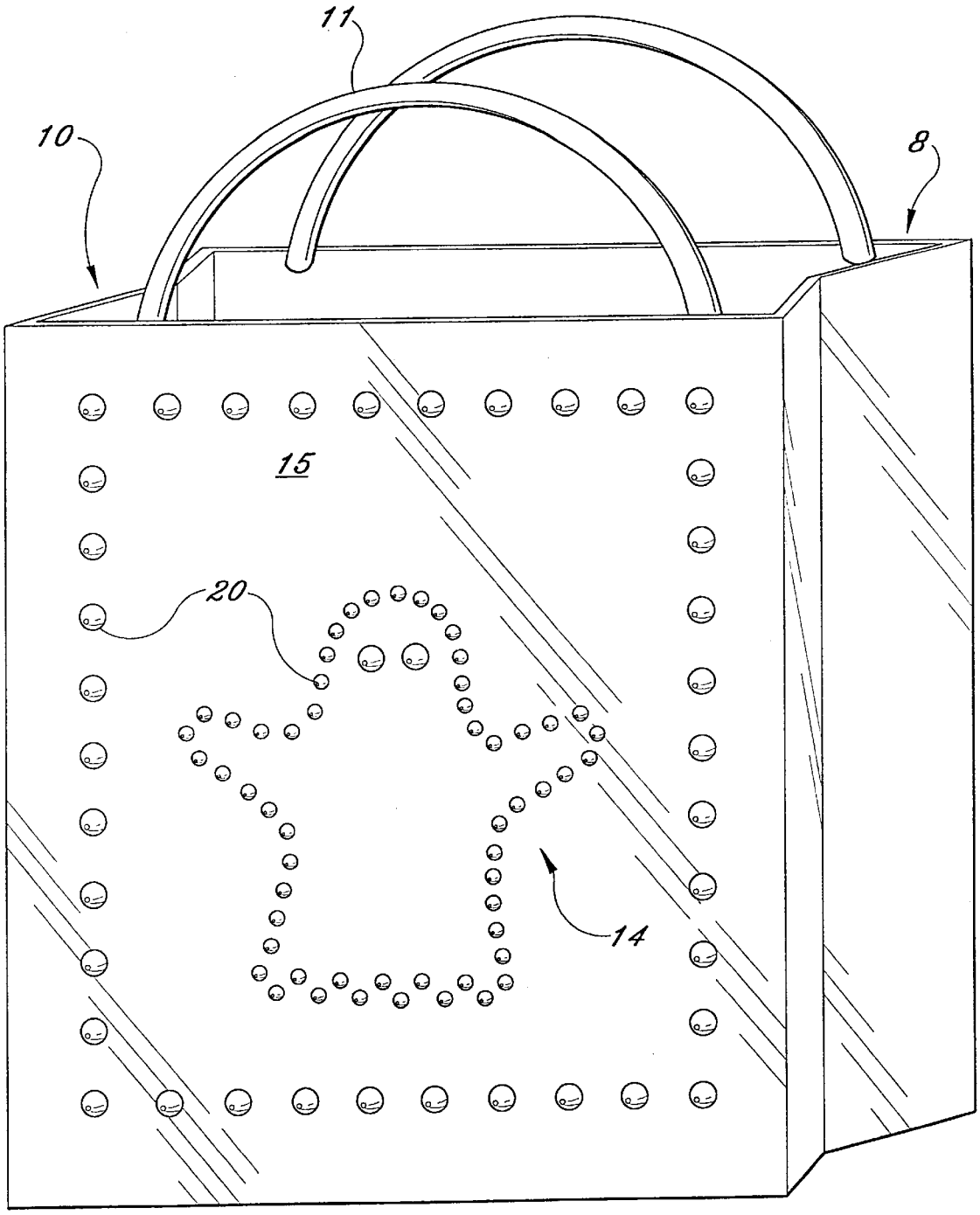
FIG. 1 is perspective view of a decoratively illuminated carrying device according to the present invention.
Figure 2:
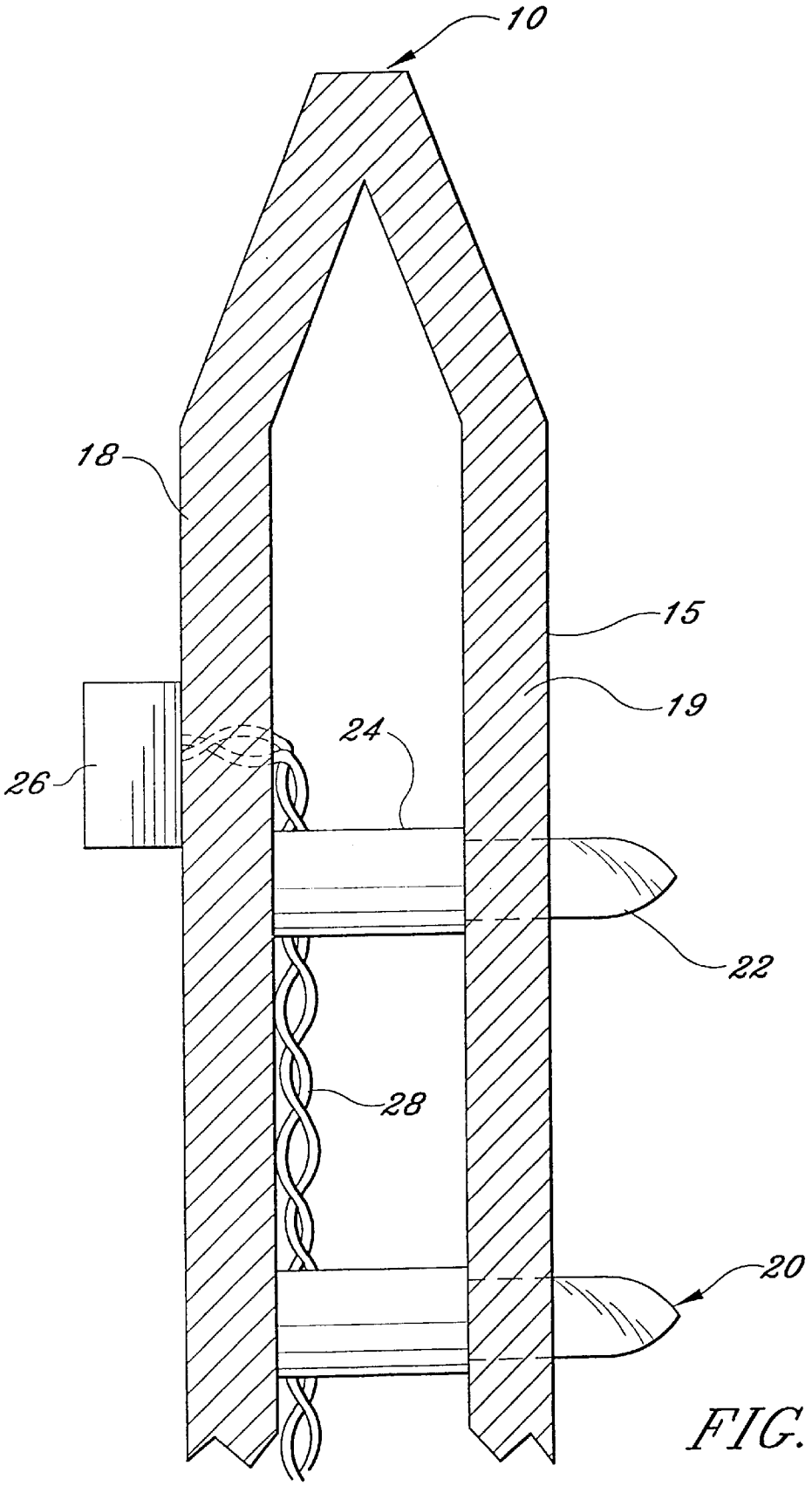
FIG. 2 is sectional, side view of the lights and electrical system disposed relative to the two plies of the bag.
Figure 3:
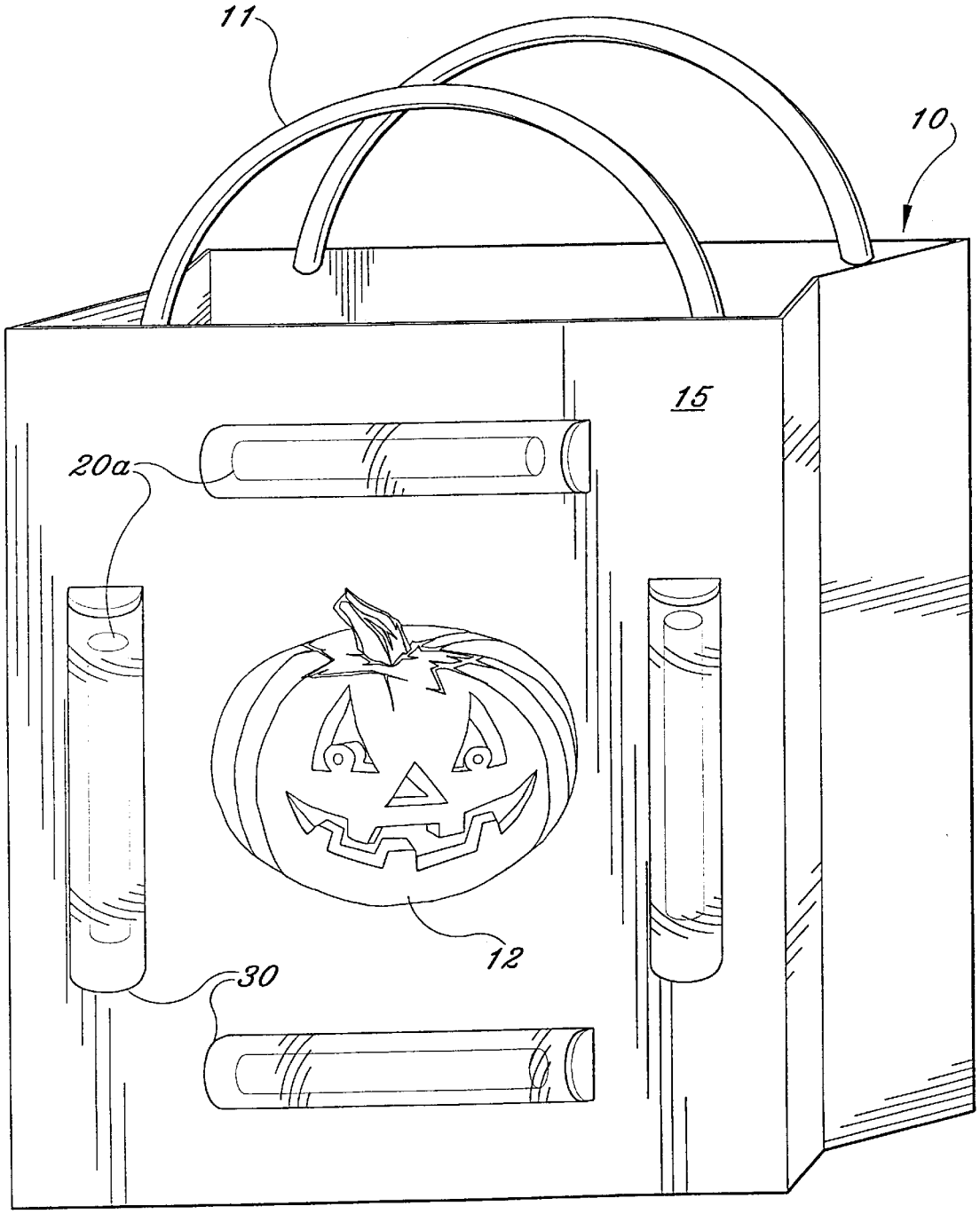
FIG. 3 is perspective view of an alternate embodiment wherein light sticks are disposed within positionable, transparent pouches, outside a conventional bag.

As depicted by FIG. 1 through FIG. 5, the decoratively illuminated carrying device 8 according to the present invention comprises a carrying bag 10 having a bag handle 11 and an exterior surface 15, and a plurality of lights 20. FIG. 1 depicts an exterior surface 15 which is shiny and reflective. FIG. 3 depicts an exterior surface 15 which additionally contains a decorative picture 12, namely of a jack-o-lantern, as is traditionally applied to a Halloween bag.

In one preferred embodiment depicted by FIG. 1 and FIG. 2, the carrying bag 10 is constructed of an inner ply 18 and an outer ply 19. The lights 20 comprise light bulbs 22 which are of various size, light sockets 24 which receive the light bulbs 22, an electric power supply 26, and wiring 28 which interconnects the power supply 26 to the light sockets 24. The wires 28 and light sockets 24 are secured between the two plies 18, 19, out of view, and the power supply 26 is affixed to the interior of the inner ply 18 of the carrying bag 10. The light bulbs 22 protrude through the outer ply 19 and are positioned in a decorative pattern 14 to illuminate the exterior surface 15 of outer ply 19. The decorative pattern 14 shown is that of a ghost, yet those skilled in the art will readily appreciate that other decorative patterns may be used in alternative embodiments, such as a witch, monster, vampire, jack o'lantern, or goblin.

Figure 4:
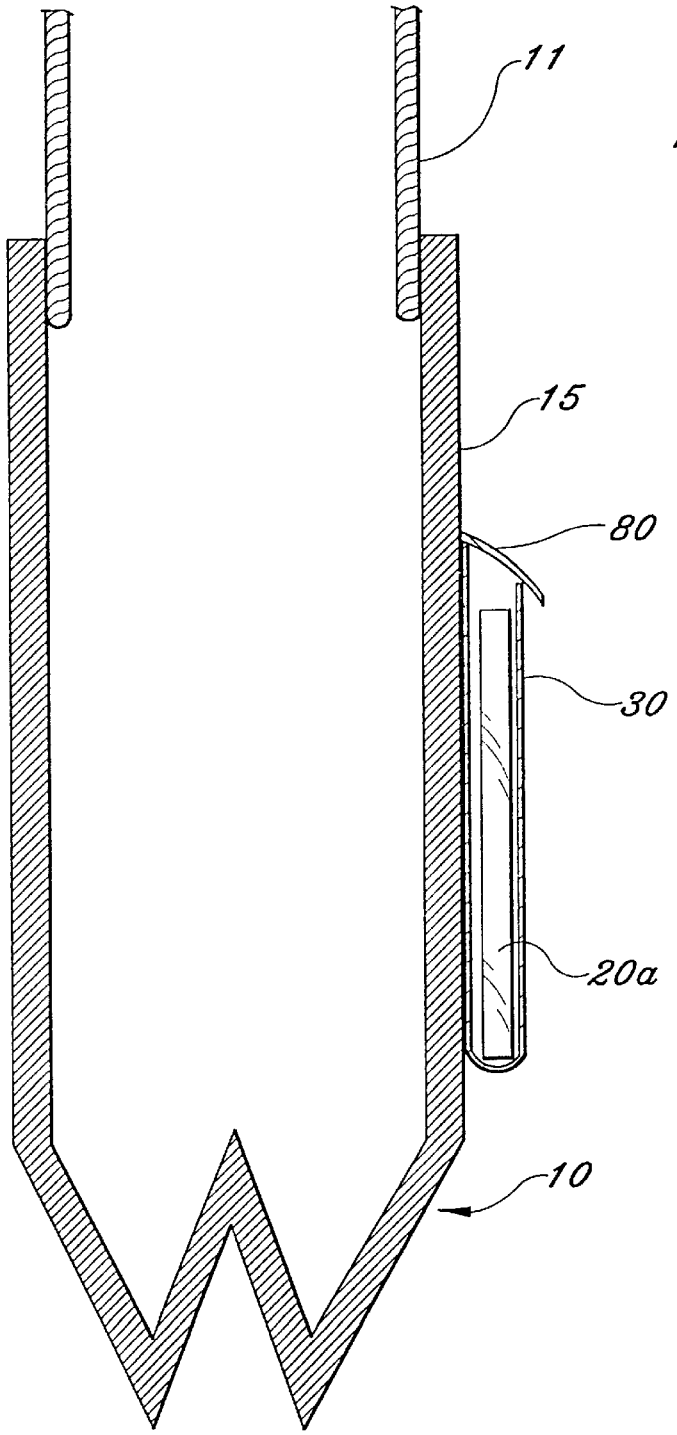
FIG. 4 is a sectional, side view of a light stick within a pouch affixed to a bag.
Figure 5:
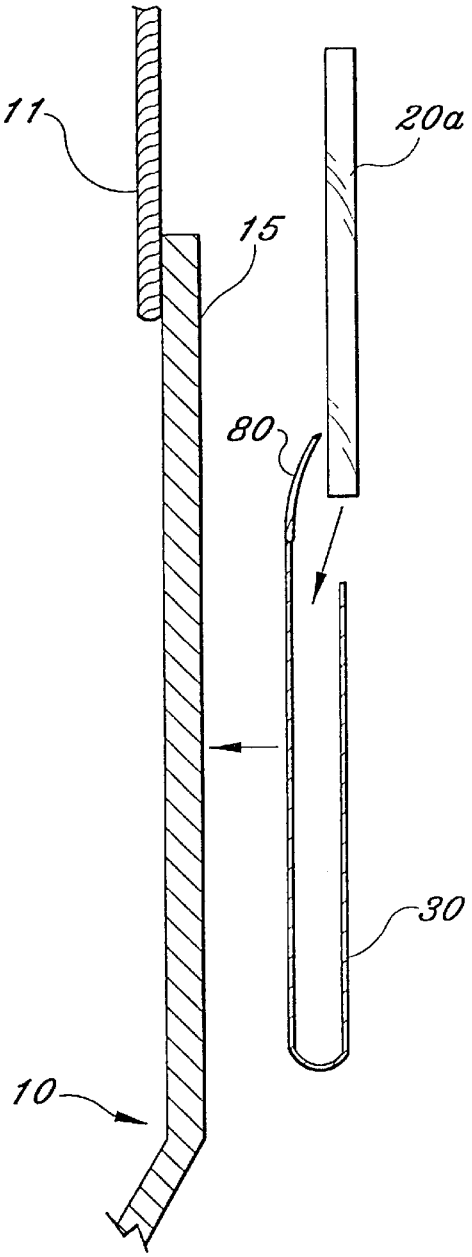
FIG. 5 is an exploded partial view of FIG. 4.

In an alternate preferred embodiment depicted by FIG. 3 through FIG. 5, a plurality of light sticks 20*a* are placed within transparent pouches 30. Each pouch 30 is dimensioned and configured to closely match the size and dimensions of a standard elongated light stick 20*a* while permitting the light stick to be inserted therein. The pouch 30 is further provided with a flap 80 which serves as a means for preventing the light stick 20*a* from falling out of the pouch. The flap 80 covers a mouth of the pouch through which the light stick is inserted. The transparent pouches 30 are, in turn, affixed to a conventional carrying bag 10 in a decorative arrangement. The pouches 30 may be provided either with an adhesive backing and release liner (not shown) to allow a user to decorate the bag 10 as desired, or permanently adhered to the bag.

It is to be understood that the present invention is not limited to the embodiments described above, but encompasses any and all embodiments within the scope of the following claims.

I claim:

1. A decoratively illuminated carrying device, comprising:

a carrying bag constructed of an outer ply having an exterior surface and an inner ply;

a plurality of light sockets disposed between said inner ply and said outer ply of said carrying bag in a predetermined fashion;

a plurality of light bulbs screwed into said light sockets, said light bulbs protruding through said outer ply of said carrying bag and configured to form a predetermined, decorative illuminated pattern;

a power supply disposed upon said carrying bag; and wiring to electrically connect said power supply to said light sockets.

2. The decoratively illuminated carrying device according to claim 1, wherein said decorative pattern is selected from the group consisting of witches, monsters, vampires, jack o'lanterns, ghosts and goblins.

3. The decoratively illuminated carrying device according to claim 1, wherein said power supply comprises at least one battery contained within a child-proof battery cartridge configured to prevent a child from opening said cartridge and losing said at least one battery.

* * * * *